United States Patent [19]

Gehring et al.

[11] 4,173,847

[45] Nov. 13, 1979

[54] FEEDING DEVICE FOR A CHIP REMOVING TOOL FOR MACHINING BORES IN WORKPIECES, ESPECIALLY A HONING TOOL

[75] Inventors: Heinz Gehring; Albert Bender, both of Ostfildern; Günter Richter, Nabern; Reinhard Fröschle, Ostfildern, all of Fed. Rep. of Germany

[73] Assignee: Maschinenfabrik Gehring Gesellschaft mit beschränkter Haftung & Co. Kommanditgesellschaft, Ostfildern-Nellingen, Fed. Rep. of Germany

[21] Appl. No.: 711,483

[22] Filed: Aug. 4, 1976

[30] Foreign Application Priority Data

May 5, 1976 [DE] Fed. Rep. of Germany ..... 2619741

[51] Int. Cl.[2] ..... B24B 5/10

[52] U.S. Cl. ..... 51/34 J; 51/165.85; 51/349

[58] Field of Search ..... 51/34 J, 165.82, 165.83, 51/165.85, 165.93, 347, 349

[56] References Cited

U.S. PATENT DOCUMENTS

| | | | |
|---|---|---|---|
| 2,050,261 | 8/1936 | Blood | 51/165.83 X |
| 2,265,800 | 12/1941 | Connor | 51/349 |
| 2,787,866 | 4/1957 | Gross | 51/165.93 X |
| 2,882,741 | 4/1959 | Liebmann | 51/165.85 X |
| 3,039,240 | 6/1962 | Balsiger | 51/165.83 |
| 3,702,043 | 11/1972 | Burkewood | 51/165.93 X |
| 3,849,940 | 11/1974 | Yoshino | 51/165.93 X |

*Primary Examiner*—Gary L. Smith

*Attorney, Agent, or Firm*—Becker & Becker, Inc.

[57] ABSTRACT

A feeding device, especially for a honing tool, in which a frame is formed with a cylinder having a piston mounted therein and to which is connected a spindle or feed rod having the tools mounted thereon. The piston will effect rapid advance and retraction of the feed rod while the connection of the piston to the feed rod embodies threaded means which can be adjusted incrementally or manually to effect fine feeding movement of the tools following the rapid advance thereof. Automatic control means are provided for controlling the incremental feeding of the tools and for compensating for tool wear.

30 Claims, 8 Drawing Figures

FEEDING DEVICE FOR A CHIP REMOVING TOOL FOR MACHINING BORES IN WORKPIECES, ESPECIALLY A HONING TOOL

The present invention relates to a feeding device for a chip removing tool for machining bores in workpieces, especially a honing tool, which feeding device comprises a partially hollow working spindle mounted in a housing and an axially displaceable feeding rod which is coaxially arranged in the working spindle.

With heretofore known honing tools with radially displaceable honing strips or honing stones, such honing stones are continuously at the same pressure pressed against the surface of the workpiece surface to be machined. Customarily, to this end, axially displaceable hydraulic pistons are employed which through the intervention of a feeding rod and conical guiding means bring about the radial displacement of the honing stones. However, experience has shown that with the heretofore known tool the honing stones follow the uneveness of the respective surface to be machined of the workpiece so that, therefore, no precisely cylindrical bore is assured.

For purposes of avoiding this defect, feeding devices for honing tools have become known according to which the radially outwardly directed feeding movement of the honing stones under pressure is limited by an abutment which is adjustable within narrow limits, or in which the honing stones are intermittently fed by mechanical or hydromechanical means. While it is possible with these devices to compensate or equalize irregularities of the preceding machining operation and to machine the workpiece precisely as to the desired dimension, a fully automatic operation, however, cannot be carried out without further steps being taken. In addition thereto, there is to be mentioned the fact that the obtainable honing efficiency is not always sufficient because an automatic change and adaptation of the feeding step sequence in conformity with the advance or progress of the working steps is not provided. Furthermore, with the heretofore known devices of the type involved there exists the danger that if the feeding sequence has not been properly set, breakage of the tools or undue long honing periods may occur in view of idling. Also due to carelessness on the part of the operator damage to the workpiece and the machining tool may occur caused by worn honing stones. Finally, the heretofore known devices referred to above have a rather complicated structure and are relatively complicated to use and therefore are liable to disorders.

It is, therefore, an object of the present invention to provide a device of the above mentioned general character which will assure a substantially automatic operation of the machining process with a maximum of output and precision while the device is simple in construction and will for all practical purposes eliminate damage to the machining tool and the workpiece.

These and other objects and advantages of the invention will appear more clearly from the following specification in connection with the accompanying drawings, in which.

FIGS. 3 through 7 respectively diagrammatically illustrate different embodiments of the feeding device according to the invention with the hydraulic and electric controls pertaining thereto.

Figure 8:
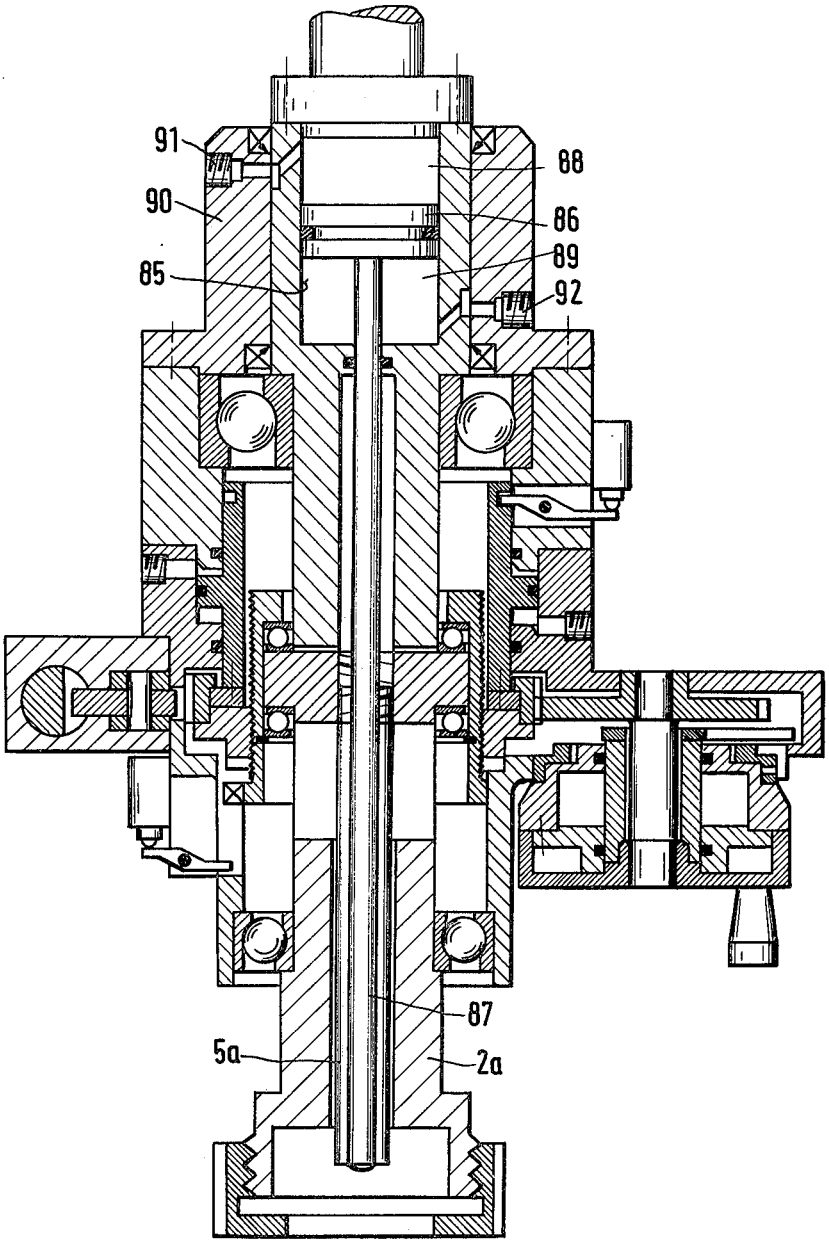

FIG. 8 is an axial section through a further embodiment of a feeding device according to the invention.

The feeding device according to the present invention is characterized primarily in that the feeding rod is adapted continuously and at one and the same pressure to be acted upon through the intervention of a hydraulic feeding piston and/or is adapted automatically intermittently to be acted upon by a hydromechanical transmission connection. The feeding device according to the invention is furthermore characterized by electric control means by means of which the feeding movement is automatically adaptable to the advance in the working operation.

With the device according to the invention, the fast advance of the tool, for instance of the honing stones, to the workpiece surface to be machined and the fast retraction after completion of the respective working step are effected at the same pressure by means of a hydraulically operable feeding piston. During the fine advance, following the fast advance, the cutting output is no longer dependent on the honing stones acting at a certain pressure upon the surface of the workpiece, but the machining operation is predetermined whereby a fast correction of the shape of the bore in the workpiece will be realized with a minimum of machining allowance. To this effect, the device according to the present invention is equipped with a hydromechanical device which brings about an automatic intermittent feeding advance and permits an automatic adaptation of the sequence of the feeding steps to the machining advance or progess. This means that the interval between the individual feeding steps is no longer constant but is variable and during the machining operation is by suitable control means adapted to the working phases whereby over heretofore known devices a greater precision and higher machining output will be realized.

Advantageously, for instance at the start of the fine advance, it is possible by means of a very fast advance pulse sequence to bridge the feeding stroke up to the corresponding premachining dimension while a load-dependent control initiates the shift-over to a correspondingly slower subsequent pulse sequence. Thereafter there is effected a fast honing operation and correction of any possible defects in the desired shape up to a last machining phase at a still lower feeding speed whereby a considerable improvement of the machined surface and still greater precision of the geometry and the dimension of the bore of the workpiece will be realized. The stepwise fine advance lasts until a timing, counting or measuring device indicates that the bore has reached its intended final dimension. Subsequently, by a hydraulically acting rotary piston, the return stroke of the fine advance steps is initiated. The magnitude of the return stroke is dependent on the machining allowance in the bore of the workpiece to be machined and may be set on a scale ring.

According to a further embodiment of the invention, there is provided an additional pulse emitter for an automatic correction of the wear of the honing stones, which pulse emitter emits feeding pulses to the fine advance mechanism in conformity with the measurable wear of the honing stones and thereby without a separate measuring device assures the precision of the dimension of the machined bores for a large series of workpieces. After the honing stones have completely worn down, the feeding is automatically blocked and light or sound signals tell the operator that the honing stones need to be replaced.

Very close tolerances of the workpiece bores are realized when, in conformity with a further embodiment of the invention, the control device for the fine advance is connected with a post-measuring device known per se. With such post-measuring device, which is recommended in particular for small bore dimensions, the workpieces, after they have been machined, are automatically measured, for instance by means of a pneumatic measuring mandrel or gauge, and by a control device correction pulses are conveyed to the fine advance. When the control for the fine advance is suitably combined with an automatic wear correction and with a post-measuring device, the turn-off precision can still be further increased over corresponding heretofore known possibilities whereby even extreme requirements as to the machining precision of the workpiece can be met. The pulse emitter for the honing stone wear will in this connection also take into consideration a basic wear assumed to be constant, whereas the post-measuring device will correct variations which occur, for instance, in view of changes in the material of the honing stones or in the material of the workpieces to be machined.

According to a further embodiment of the invention, the device is equipped with an overload safety mechanism which in response to a too high feeding speed interrupts the fine advance until the honing stones have cut themselves free again. In this way a trouble-free course of the machining operations will be assured and damage due to breakage of the tools will be avoided.

Figure 1:
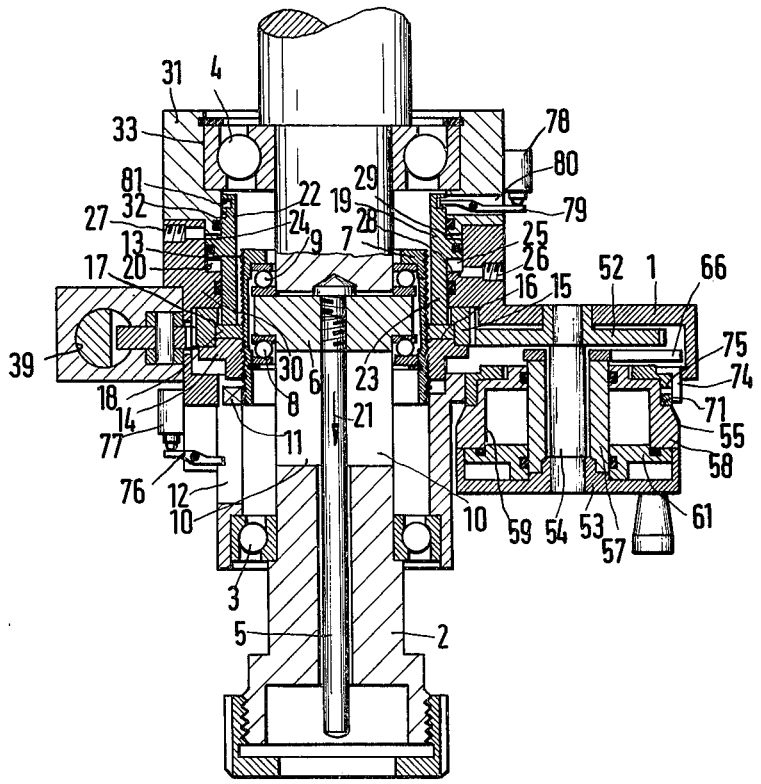
FIG. 1 is an axial section through a feeding device according to the invention.

Referring now to the drawings in detail, the feeding device illustrated in FIG. 1 comprises a housing 1 in which the working spindle 2 is rotatably journalled by means of ball bearings 3, 4. Advantageously, the ball bearings 3, 4 are designed as detachable journal ball bearings in order to locate and fix the working spindle 2 also in axial direction.

Centrally arranged in the partially hollow working spindle 2 is a feeding rod 5 the purpose of which consists in pressing the honing stones of the non-illustrated tool against the workpiece surface to be machined. The feeding rod 5 is to this end in a manner known per se, for instance by means of conical elements, so connected to the holders for the honing stones that an axial movement of the feeding rod 5 brings about a radially directed feeding movement of the honing stones. The upper end of the feeding rod 5 is firmly screwed into a transverse wedge 6 which is rotatably but axially non-displaceably mounted in a threaded sleeve 7 between two axial grooved ball bearings 8, 9, the threaded sleeve 7 being arranged coaxially to the working spindle 2 and the feeding rod 5. The feeding rod 5 is thus by means of the transverse wedge 6 and the axial grooved ball bearings 8, 9 positively connected to the threaded sleeve 7. This means that when the threaded sleeve 7 is moved axially, also the feeding rod 5 is moved axially relative to the working spindle 2. Accordingly, the working spindle is equipped with an axial longitudinal bore 10 through which passes the transverse wedge 6.

The threaded sleeve 7 is at its lower end provided with a nose 11 which points in the feeding direction indicated by the arrow 21. This nose 11 extends into an axial slot 12 provided in housing 1 and prevents the threaded sleeve 7 from turning while keeping it axially movable. The nose 11 in slot 12 is visible from the outside. In view of the positive connection of the threaded sleeve 7 with the feeding rod 5, the location and movement of the feeding rod 5 can be observed also during the honing operation.

Movably arranged on the sleeve 7 which is provided with an outer thread 13 is a feeding nut 14 which is provided with a corresponding inner thread and which is firmly connected to a coaxially arranged gear 15, for instance, is screwed thereto.

Between the end face 16 of the feeding nut 14 and a collar (Bundaufwurf) 17 on gear 15 there is in a positive manner received a bearing ring 18 which is firmly connected or abutting onto a feeding piston 19 which is arranged above the gear 15 in a coaxial bore 20 of housing 1. As a result thereof, the feeding nut 14 is rotatably but axially non-displaceably connected to the feeding piston 19. The piston 19 is designed as a hollow piston and is partially passed through by the threaded spindle 7. This means that each axial movement of the feeding piston 19 is through the intervention of the bearing ring 18 and the feeding nut 14 conveyed onto the threaded sleeve 7. When the feeding nut 14 is turned through the intervention of gear 15, additionally and automatically through the intervention of the thread connection 13 there is brought about an axial displacement of the threaded sleeve 7 toward the feeding piston 19 which axial displacement corresponds to the pitch of the thread. The feeding piston 19 comprises two sections 22, 23 which extend in the axial direction and have a smaller diameter than piston 19. The piston 19 forms in bore 20 of housing 1 two chambers 24, 25 which through the connecting bores 26, 27 for purposes of an axial movement of the piston 19 are alternately subjected to the action of a pressure fluid. This axial movement is in the feeding direction indicated by arrow 21 limited by the end face 28 of the chamber 25 and in opposite direction is limited by the end face 29 of the chamber 24. The end face 28 is formed by a collar (Bundaufwurf) 30 in the bore 20 which collar 30 is passed through in a pressure-tight manner by the thinner section 23 of the feeding piston 19. The end face 29 is formed by a bearing cover 31 which is firmly screwed onto the housing 1. The cover 31 has a bore 32 into which extends the thinner section 22 of the feeding piston 19 in a pressure-tight manner. The bearing cover 31 furthermore receives the ball bearing 3 for journalling the working spindle 2 and does so within the portion 33 of bore 32 which portions widens in axial direction.

Figure 2:
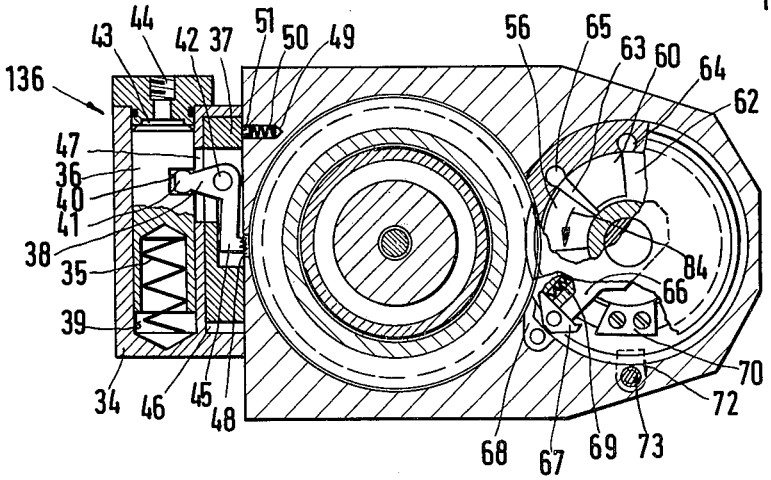
FIG. 2 represents a cross section through the feeding device of FIG. 1.

As has been shown in greater detail in FIG. 2, a control block 136 is connected on the outside of and to the housing 1 at the level of the gear 15. This control block 136 comprises primarily a control housing 34 for receiving a piston 36 which is movable by a pressure medium or by the force of a spring 35, and furthermore comprises a slidable member 37 for the mounting of an angle lever 38.

The piston 36 which is guided in a bore 39 extending transverse to the feeding direction indicated by the arrow 21 comprises a nut 40 positively engaged by the end 41 of the angle lever 38. The mounting and arrangement of the angle lever 38 by means of bolt 42 on the slidable member 37 is so effected that when a pressure medium is conveyed to a chamber 43 through a connecting bore 44, the piston 36 will move against the thrust of spring 35 as a result of which first the other end 45 of angle lever 38, which end forms a rack, will mesh with the gear 15 and subsequently will take along the slidable member 37 whereby the gear 15 is turned further about one tooth division. To this end, the member 37 is displaceably arranged parallel to the bore 39 in a groove-shaped recess 46 which is located in the control housing 34 between the latter and the housing 1. Control housing 34 and housing 1 are equipped with longitudinal bores 47, 48 respectively through which extends the angle lever 38.

The return of the piston 36 is effected by the thrust of spring 35 whereby first the angle lever 38 is disengaged from the bear 15 and subsequently the member 37 is moved to its starting position. For assuring the proper sequence of movement, a brake bolt 51 is provided in a bore 49 of housing 1, this brake bolt acting upon the member 37 due to the pressure of a spring 50. With each back and forth movement of the piston 36, the gear 15 is advanced by one tooth division, and thus through the feeding nut 14 the threaded sleeve 7 is advanced axially by a short stroke in the feeding direction indicated by the arrow 21.

To permit a manual adjustment of the gear 15, the latter meshes with a gear 52 which is journalled on the housing 1 in an axis parallel manner and which has a smaller diameter than gear 15. Gear 52 is adjustable from the outside by means of a handwheel 53 and the connecting shaft 54. As a result thereof, the threaded sleeve 7 and the feeding rod 5 connected thereto are moved upwardly and downwardly in conformity with the respective direction of rotation. The magnitude of the adjustment can be read on a scale provided on the handwheel 53.

Between the gear 52 and the handwheel 53 and coaxially with regard to shaft 54 there is provided a rotatable cylinder 55. The rotary piston 56 pertaining to the cylinder 55 has the shape of a circular segment and is firmly connected to a bushing 57 through which extends the shaft 54. The cylinder housing in which the rotary piston 56 is journalled for rotation about the central axis of bushing 57 comprises a flange-like part 58 which is provided with a cylinder bore 59 and is fixedly connected to the housing 1. The cylinder housing in which the rotary piston 56 is rotatably journalled also comprises a second circular segment 60 which is fixedly arranged in the cylinder bore 59. By means of the rotary piston 56, the stationary circular segment 60, and a cover 61 closing the cylinder bore 59 there are formed two cylinder chambers 62, 63 which can be supplied with pressure fluid through connecting bores 64, 65 respectively.

The upper end of bushing 57 is provided with a lever 66 having rotatably journalled thereon a pawl 67. As will be evident from FIG. 2, pawl 67 is in the starting position of the rotary piston 56 out of engagement with the gear 52 due to an abutment lever 68 fixedly arranged in housing 1.

After pressure fluid has been supplied to chamber 63, the bushing 57 turns in the direction of the arrow 84. As a result thereof, the pawl 67 is freed from the abutment lever 68 and in view of the thrust of a spring 69 arranged in lever 66 engages gear 52 and takes the same along. Through the intervention of the above mentioned transmission connection, the threaded sleeve 7 and thus also the feeding rod 5 are moved upwardly whereby the honing stones 82 (FIG. 3) are returned.

The magnitude of the return movement of the honing stones 82 is limited by an adjustable abutment 70 against which abuts the lever 66 during the further course of the rotary movement. The abutment 70 is fixedly screwed onto a scale ring 71 which for purposes of adjusting the abutment 70, is rotatably arranged on the cylinder housing 58 and can be clamped fast in any position by means of two clamping members 72 and screws 73. The adjustment of the abutment 70 can be effected and read on a window 74 in housing 1 through the intervention of plug holes 75 in the scale ring 71.

In the course of the machining operation and with increasing wear of the honing stones inherent thereto, the threaded sleeve 7 moves steadily further downwardly in the direction of the arrow 21 until the nose 11 will, after complete wear of the honing stones has taken place, move onto a lever 76 which extends into the lower end of the axial slot 12, lever 76 actuating a limit feeler 77 connected to housing 1.

A further limit feeler 78 will through the intervention of a positively engaging lever 79 feel the lifting off of the feeding piston 19 from the lower abutment surface 28. The lever 79 is mounted in a slot 80 of the cover 31 and positively engages an outer annular groove 81 provided in the section 22 of the feeding piston 19.

FIGS. 3–7 diagrammatically illustrate the above described feeding device in cooperation with the hydraulic and electric controls. The function of these controls will now be explained and the individual control elements will be discussed.

A non-illustrated stroke control device conveys to the feeding control 102 by means of a signal 101 the order "turn on the feeding operation". Thereupon the feeding control 102 conveys through a signal 103 voltage to a magnet valve 104 which moves into the illustrated position designated with the numeral II. As a result thereof, pressure fluid passes from a hydraulic unit 105 into the cylinder chamber 24 onto the top side of the feeding piston 19 and into the cylinder chamber 62 of the rotary cylinder 55. The feeding piston 19 moves downwardly and the honing stones 82 (FIG. 3) are advanced at a high speed. Simultaneously, with the signal 103, a signal 106 energizes a time relay 107 for the fine advance.

The pulse sequence, in other words the time interval between the individual feeding steps, is set on a potentiometer 110 and is conveyed through a signal 111 to a timing generator (Taktgeber) 109. After completion of the pulse sequence, the timing generator 109 sends through a signal 112 an order to the magnet valve 113 for the fine advance which latter moves into the position "I" and supplies pressure oil onto the piston 36. The piston 36 moves against the thrust of spring 35 to its other end position while turning the gear 15 by one tooth division in the described manner through the intervention of the slidable member 37 and the angle lever 38 (FIG. 1). As a result thereof, the honing stones 82 are slightly advanced.

The timing generator 109 is so set that the signal 112 will last only for the time which is required for the reversal of the piston 36 so that the latter is immediately following the feeding step by means of the thrust of spring 35 again moved to its starting position. This means that for each feeding step after the expiration of the pulse sequence time the piston 36 carries out a fast back and forth movement until the timing generator 109 is blocked by extinguishing of a signal 108.

Figure 3:
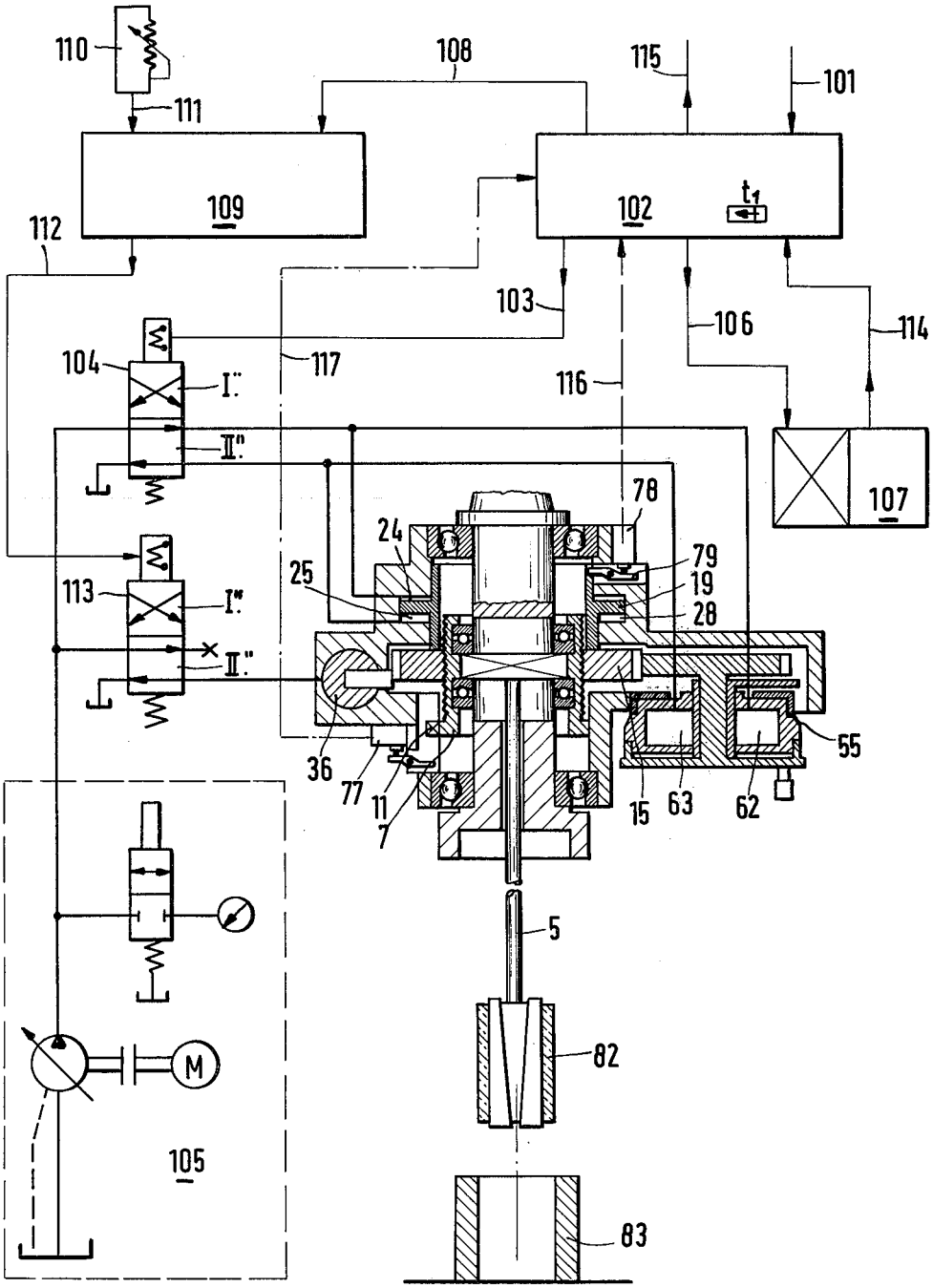

According to the arrangement of FIG. 3, the extinguishing of signal 108 is effected by means of a signal 114 which is emitted by the time relay 107 to the feed control 102 after the set working time has expired. Simultaneously with the extinguishing of the signal 108 a time member $t_1$ is started which will assure that an already started fine feeding operation will still be carried out before, by extinguishing the signal 103, the movement of the magnetic valve 104 is reversed and before through a signal 115 the order "honing operation completed" is conveyed to the non-illustrated stroke control device. The magnetic valve 104 then returns to its rest position as a result of which the cylinder chambers 25 and 63 are acted upon by pressure fluid and the cylinder chambers 24 and 62 are connected with the return line leading to the tank of the hydraulic unit 105. The feeding piston 19 moves upwardly and quickly pulls back the honing stones 82. At the same time the rotary piston 56 rotates in the direction of the arrow 84 (FIG. 2) up to the abutment 70 and sets back the advanced fine feeding steps.

A brief extinguishing of the signal 108 may, if desired, also be initiated by the limit feeler 78. When such limit feeler has been installed, the signal 108 is released by the feeding control 102 only when the limit feeler 78 is depressed and conveys a signal 116 to the feed control 102. The limit feeler 78 will then be depressed by the lever 79 when the feeding piston 19 at the start of the honing operation moves downwardly and engages the abutment surface 28. If the fine advancing pulses during the honing operation occur at too fast a sequence, the pressure upon the feeding rod 5 becomes so great that the feeding piston 19 is pressed upwardly away from the abutment surface 28. The limit feeler 78 will thus be freed and will turn off the signal 116 for the feed control 102 as a result of which in a further sequence with the signal 108 the timing generator 109 will be blocked. Further fine adjustment steps will thus again be possible only when the honing tool has cut itself free and the pressure upon the feeding rod 5 has been lowered to such an extent that the feeding piston 19, due to the pressure in the cylinder chamber 24, again engages the abutment surface 28. In this way an overload of the feeding device in view of too fast a feeding sequence and thus damage to the tool will be avoided.

Furthermore, the signal 108 can also be stopped by the limit feeler 77 which, as mentioned above, is actuated by the nose 11 of sleeve 7 in case the honing stones have fully worn and which emits a signal 117 to the feed control whereby likewise damages to the tools and the workpieces will be prevented.

Figure 4:
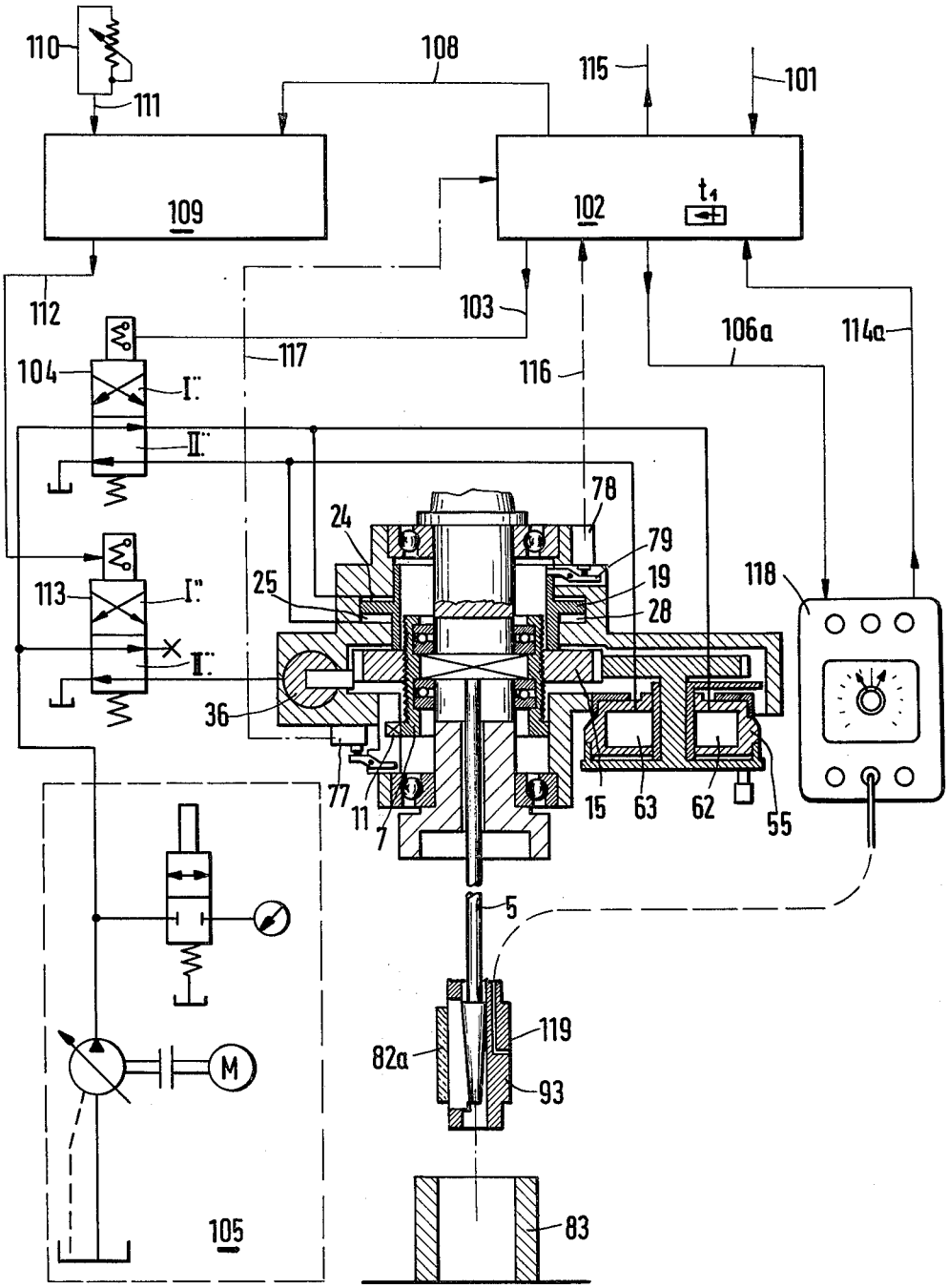

With the device illustrated in FIG. 4 the duration of the machining operation is controlled by suitable measuring devices, for instance, a pneumatic measuring device 118 which in a manner known per se through the intervention of a honing tool 93 equipped with measuring nozzles 119 checks the diameter of the workpiece 83 during the machining operation. By means of a signal 106*a* emitted by the feed control 102, the measuring device 118 is turned on at the start of the honing operation. When in the course of the machining operation the set desired workpiece diameter has been obtained, the measuring device will by means of the signal 114*a* initiate the termination of the honing operation. The control of the work sequence corresponds otherwise to the arrangement of FIG. 3 so that a detailed description of the function does not appear to be necessary.

Figure 5:
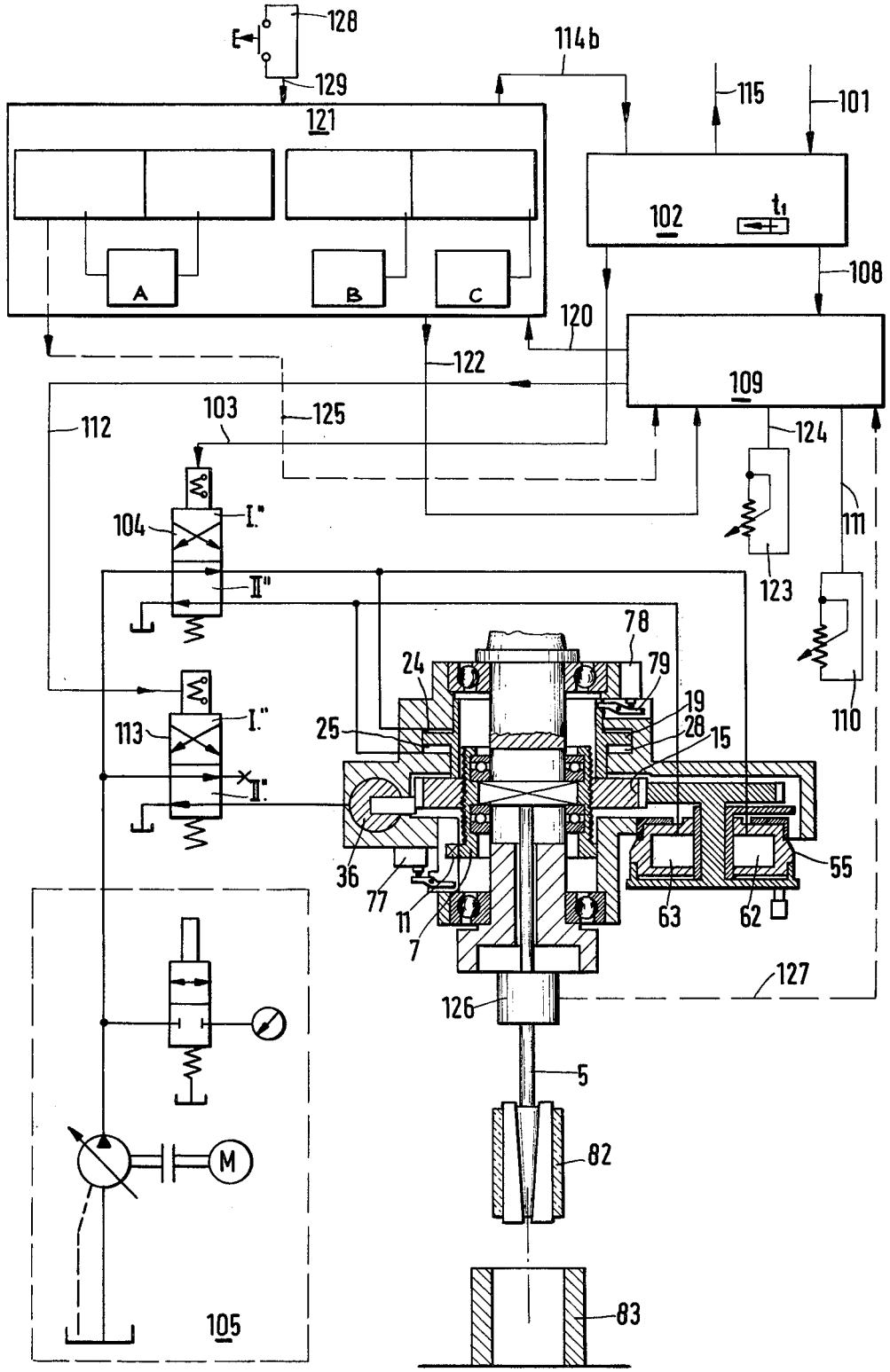

FIG. 5 illustrates a further embodiment of the invention with a so-called counting control. The turning-on of the feeding step at the start of the honing operation and the feeding operation occur in the same manner as described in connection with the arrangement of FIG. 3. There is merely lacking the time relay 107 for the setting of the machining time. Instead, with each fine feeding step, the timing generator 109 emits through a signal 120 a counting order to a counter 121 which enters this counting order in its counting stage A. The counting stage A is read or called upon by the preselector switch "total pulses", which preselector switch is set for a number of fine advancing steps required for obtaining the desired workpiece dimension. When reaching this number, by means of a signal 114*b* an order is given to the feed control 102 whereupon the signal 108 to the timing generator 109 is turned off and the time member $t_1$ is started. The timing generator 109 is thus blocked and after the operation of the timing member $t_1$ has been completed, the honing operation is terminated. The return of the honing stones 82 is substantially effected in the same manner as already described in connection with FIG. 3. The setting of the abutment 70 (FIG. 1) by means of the scale ring 71 is in this connection identical to the setting of the preselector switch "total pulses" which means that the mechanism for the previously carried out fine adjusting steps is returned to its starting position. At the same time the counting stage A of the counter 121 is returned internally to "zero" and the counting stage B of the counter 121 receives a counting signal. By means of the counting stage B there will thus be counted the number of the machined workpieces 83.

During the honing operation, the honing stones 82 are subjected to a continuous wear which with a constant number of advancing steps would result in a change in dimension of the workpiece 82. Such change in dimension is, according to the present invention, avoided in that after honing a certain number of workpieces 83 set on the preselector switch "workpieces", automatically a compensation for the wear of the honing stones is effected. The magnitude of the compensation can be set on a preselector switch "compensation". After the number of honed workpieces 83 set on the preselector switch "workpieces" has been counted into the counting stage B of the counter 121, this is by means of a signal 122 conveyed to the timing generator 109. At the same time internally in the counter 121 the counting stage A is blocked and the entry is shifted to the counting stage C. With the now following honing operation, the signals 120 conveyed to the counter 121 by the timing generator 109 is conformity with the fine advancing steps are first counted by the counting stage "C" until the number set on the preselector switch "compensation" has been reached. Thereupon internally in the counter 121 there takes place a switch-over to the counting stage A and the counting stages B and C are again returned to "zero" while simultaneously the signal 122 to the timing generator 109 is switched off. The compensating step is now completed and the honing operation is continued in the above described manner.

The compensating step is repeated each time after the same number of workpieces 83 set on the preselector switch B has been machined so that the dimension of the workpieces will even for a large series be kept within narrow limits in spite of the continuous wear of the honing stones.

The signal 122 to the timing generator 109 for the fine advance internally brings about a shift-over to the fastest possible advancing steps through the signal 112 to the magnetic valve 113 whereby the potentiometer 110 for the setting of the pulse sequence time will remain ineffective as long as the signal 122 is effective. In this way it will be assured that the feeding pulses for the honing stone wear compensation will without any material loss of time become effective as quickly as possible.

For the setting of a different feeding step sequence adaptable to the machining progress, there is in addition to the potentiometer 110 provided a further potentiometer 123 by means of which a further pulse sequence can be conveyed to the timing generator 109 by means of a signal 124. For instance, it is advantageous for the duration of the work and for the obtainable precision and surface quality when at the start of the fine advance the machining is carried out at a relatively high feeding speed to obtain a fast chip removal and correction of the shape of the workpiece, and when subsequently the machining is carried out at a correspondingly lower feeding speed to obtain a high surface quality, a precise dimension and the best geometry.

The time for shifting over is set on a preselector switch "prehoning pulses" in the counter 121. First the advancing speed sequence is determined by the potentiometer 123 until the advancing steps conveyed by the timing generator 109 through the signal 120 to the counter 121 and counted by the counting stage "A" reach the number set on the preselector switch "prehoning pulses". Thereupon through the intervention of a signal 125, a switch-over from the potentiometer 123 to the potentiometer 110 is effected which determines the further pulse sequence times until the number has been reached which was set on the preselector switch "total pulses".

Furthermore there may also be provided a load-dependent feed control which makes it possible, in particular with workpiece bores with greater tolerances of dimension, to obtain a further reduction in the machining time for the premachining step. To this end, the device is equipped with a torque hub 126 known per se which by switching off a signal 127 on the timing generator 109 indicates the frictional torque created when the honing stones 82 engage the workpiece surface. As long as the signal 127 is effective, the timing generator 109 is switched over to the fastest possible advancing sequence for fine honing by conveying a signal 112 to the magnetic valve 113, as a result of which the potentiometers 110 and 123 become ineffective. This assures a time-saving fast advance of the honing stones 82 until the honing stones cut into the workpiece surface.

Figure 6:
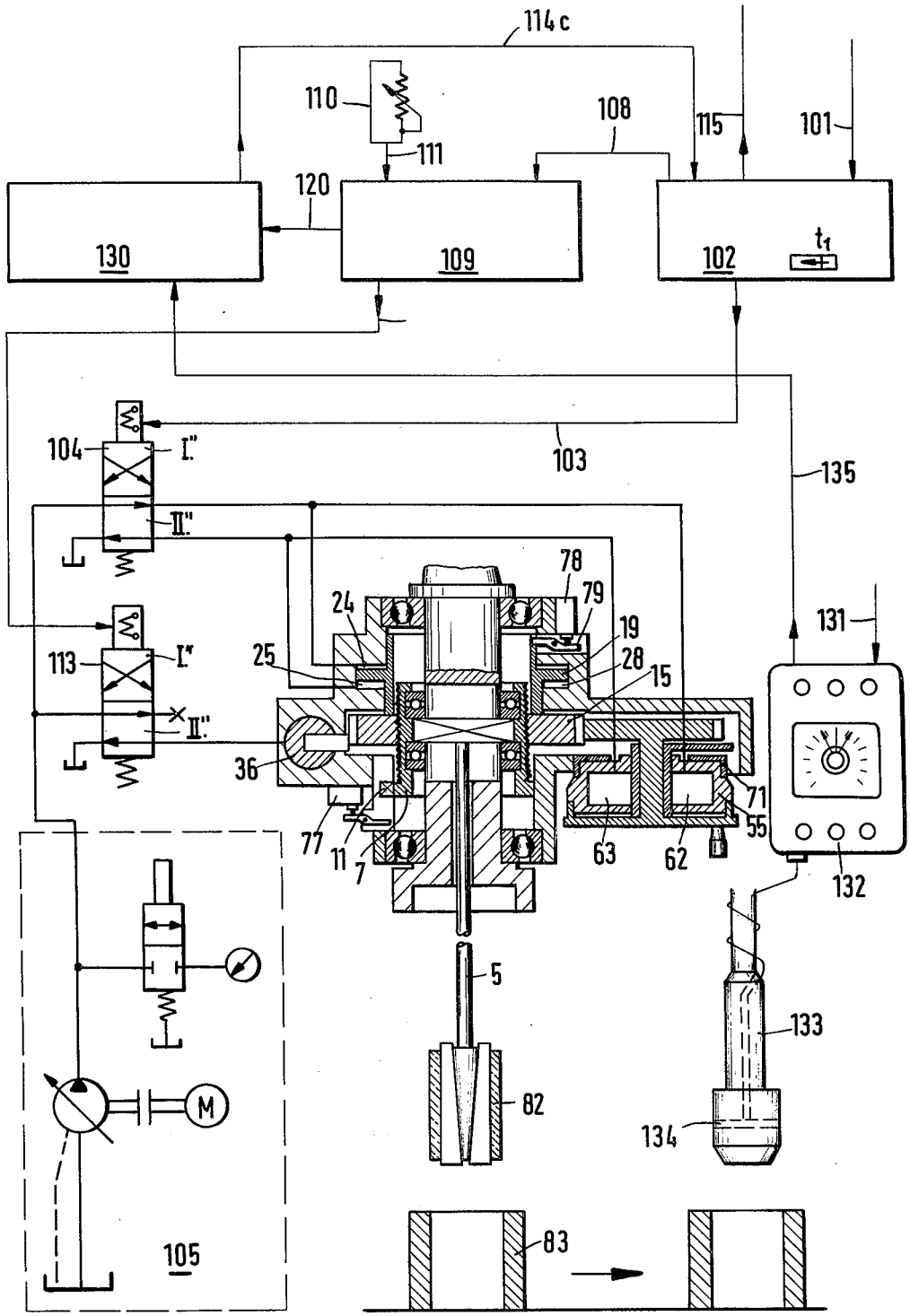

For a manual operation of the above described automatically working advance control there is additionally provided a feeler 128 by means of which further feeding pulses can be conveyed as signal 129 to the counter 121. If rather high requirements with regard to the dimensional precision of workpiece bores of small diameter are to be met, the embodiment illustrated in FIG. 6 is particularly suited which cooperates with a postmeasuring device known per se. Also in this instance the honing operation is carried out in the above described manner, i.e. from a non-illustrated stroke control device there is emitted through the feed control 102 the order "turn-on the advance". Thereupon the feed control 102 will through the signal 103 convey voltage to the magnetic valve 104 and by means of the signal 108 will convey an order to the timing generator 109. The feeding piston 19 moves downwardly and quickly advances the honing stones 82. The timing generator 109 is turned on and after expiration of the pulse sequence time set at the potentiometer 110 and conveyed by means of the signal 111, will by means of signal 112 convey to the magnetic valve 113 the order for "fine advance".

With each advancing step of the fine advance, the timing generator 109 emits by means of signal 120 a counting order to a preselector counter 130. The preselector counter 130 is set for a number of fine advance steps required for obtaining the desired dimension of the workpiece, and when this number has been reached, it emits a signal 114c to the feed control 102. The advance is then completed in the above described manner which means that the feeding piston 19 will, after the expiration of the time determined by the timing member $t_1$ move upwardly and will quickly withdraw the honing stones 82, while at the same time through the intervention of the rotary cylinder 55, in view of the identical setting of the preselector counter 130 and the scale ring 71, the mechanism for carrying out the fine advance steps is returned or reset and by means of the signal 115 the stroke control device is notified that the honing operation is completed. The honing tool 93 will then move out of the workpiece bore whereupon through a signal 131 by means of the non-illustrated machine control the post-measuring operation will be initiated. The post-measuring device diagrammatically shown in FIG. 5 primarily comprises, for instance, a pneumatic measuring device 132 known per se with a measuring mandrel 133 connected thereto. This measuring mandrel 133 is equipped with measuring nozzles 134 and for the measuring step is by suitable means automatically moved into the workpiece bore.

In this connection the arrangement may be such that the measuring mandrel 133 immerses from below into the workpiece which is still in the working station so that a separate measuring station is not necessary. Another possibility consists in transporting the workpiece 83 by means of a suitable conveying device, for instance a round switch table, to a post-measuring station where it is then measured. This possibility has the advantage that during the measuring step already a new honing step may be started so that further time losses will be avoided.

When the indication on the measuring device 132 reaches a limit value previously set and located at the end of the tolerance range of the desired dimension of the workpiece, a signal 135 is conveyed to the preselector counter 130. The preselector counter 130 then, during the following counting step of the fine advance, adds to the set number of advancing steps still one or more steps prior to initiating the end of the machining operation by means of the signal 114c. This means that a greater number of advancing steps was carried out than was returned or retracted on the basis of the setting of the scale ring 71 after effected machining. The honing tool 93 is thus advanced by an amount which corresponds to the wear of the honing stones, and the dimension of the workpiece 83 is again brought to the opposite end of the tolerance range.

When during the further machining the indication at the measuring device 132 again reaches the set value, the above described procedure is repeated. In this way it will be assured that the wear of the honing stones is continuously fully automatically compensated for and that the dimensions of the workpieces are kept in narrow limits.

Experience has shown that the obtainable turn-off precision can still further be increased over the heretofore possible precision of honing machines by a suitable combination of a device according to FIG. 5 with a post-measuring device according to FIG. 6. Such an embodiment is shown diagrammatically in FIG. 7 and is advantageously used in particular with workpieces 83 having relatively high machining allowances and requiring great precision of their dimensions. Moreover, this embodiment can also be advantageously used when for some other reasons a relatively great and for each workpiece 83 different wear of the honing stones occurs.

Figure 7:
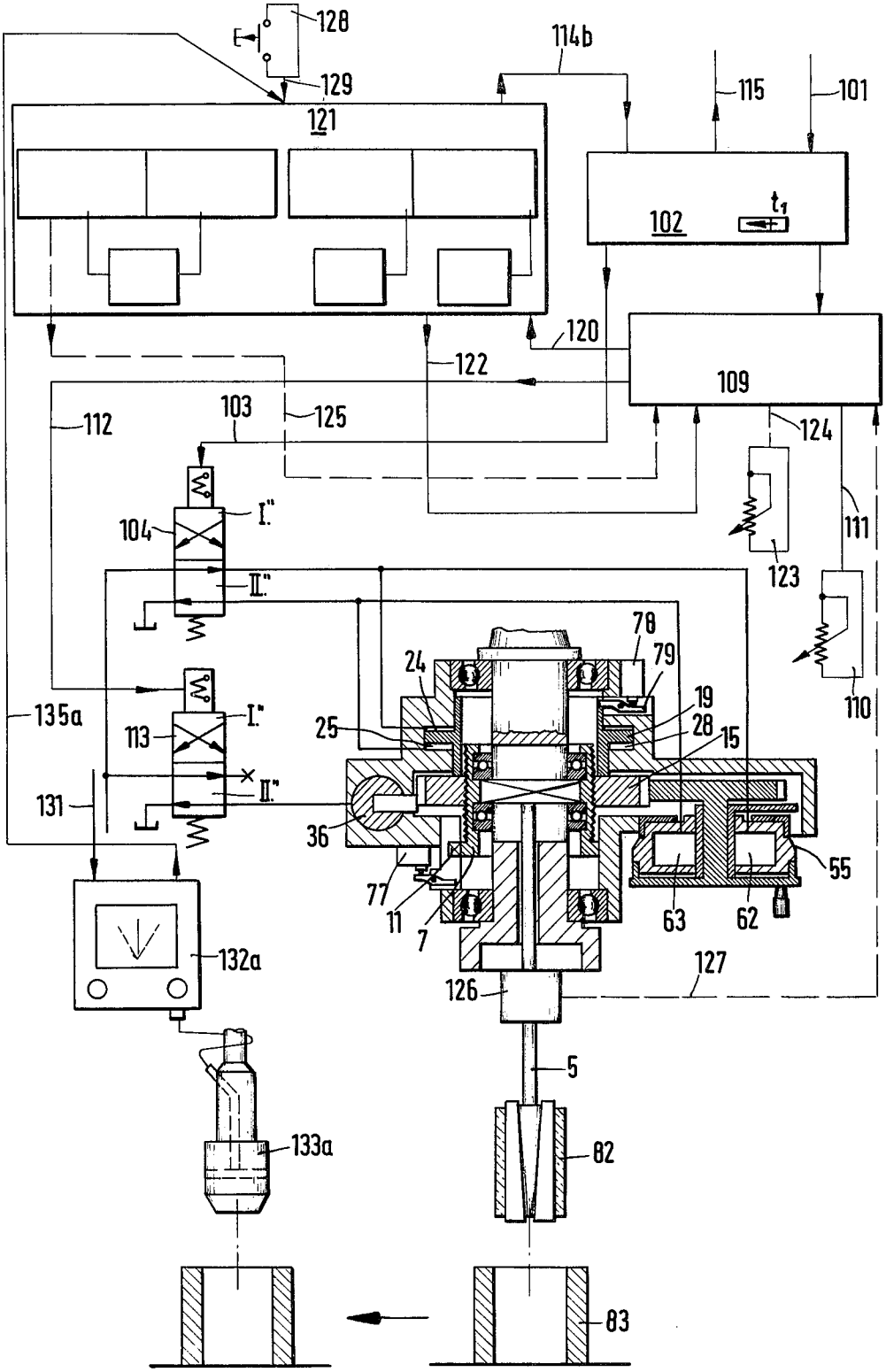

In the case of FIG. 7, a slight wear of the honing stones assumed to be constant for each workpiece 83 is set on the preselector switches "workpieces" and "compensation" in the counter 121, and this slight wear of the honing stones is conveyed to the feed control 102 in the manner described above in connection with FIG. 5.

After the honing operation each workpiece 83 is measured by means of a measuring device 132*a* and a measuring mandrel 133*a*. If the indication on the measuring device 132*a* reaches a previously set limit value, a signal 135*a* is conveyed to the counter 121, and during the next fine advance step, in addition to the basic compensation, a further advancing step is carried out. The thus obtained advantage is seen primarily in that, in view of the effected basic compensation, the differences in dimension from workpiece to workpiece are only very minor so that the limit value for the response of the measuring device 132*a* can be placed very close to the theoretical absolute dimension of the workpieces 83.

It is to be understood that the concept of the present invention, instead of being realized by the above described embodiments, can also be realized in a different manner. For instance, further combinations within the described control devices may be provided. There exists also the possibility of employing the described advancing or feeding device for the so-called plateau honing. The plateau honing is a well known honing method according to which by means of a honing tool with double advance first a pre-honing is effected by means of honing stones of a coarser grain and directly thereafter by means of honing stones of a finer grain there is produced a surface structure which is particularly advantageous for the running paths of internal combustion engines. To this end, as shown in FIG. 8, the spindle 2*a* in a cylinder bore 85 additionally receives a hydraulic power piston 86 which is firmly connected with a downwardly extending advancing rod 87. The advancing rod 5*a* of the hydromechanical feeding device shown in FIGS. 1 and 2 is in this instance tubular and is passed through concentrically by the advancing rod 87. The supply of pressure fluid to the cylinder chambers 88 and 89 is effected by means of a distributor 90 with connecting bores 91 and 92 which distributor is arranged coaxially on spindle 2*a* at the level of the hydraulic power piston 86. The double advance of the non-illustrated plateau honing tool is effected in such a way that first the honing stones of coarser grain are intermittently advanced for the prehoning operation through the intervention of the advancing rod 5*a* while the control of the advancing movement is taken over by the device according to the invention so that a fast chip removal, optimum geometry and a precise dimension of the workpiece bore are already obtained when subsequently during the second working phase by means of the hydraulic power piston 86 the honing stones of finer grain are through the intervention of the advancing rod 87 continuously advanced at uniform pressure in order by means of a few working strokes to produce the desired plateau surface structure.

It is, of course, to be understood that the present invention is, by no means, limited to the specific showing in the drawings but also comprises any modifications within the scope of the appended claims.

What is claimed is:

1. A feeding device for a honing machine tool comprising in combination: a housing, a spindle rotatable in the housing, an axially displaceable feed rod on the axis of said spindle and the other end adapted for connection to tool means, fluid operable piston means in the housing operable for urging said feed rod in at least one direction, feed means for incrementally adjusting the axial position of said feed rod relative to the spindle, and electric actuating means operable for automatically operating at least feed means control means operable for causing said electric actuating means to emit control pulses periodically to effect said incremental adjustment of the feed rod measuring means for supplying a signal to said control means for making said control means ineffective said measuring means comprising a counter which counts the number of control pulses said counter comprising a plurality of adjustable counting stages and selector switch means for making the respective stages effective, said counting stages including a first stage for controlling the number of pulses supplied by said electric actuating means for advancing the feed rod, a second stage which counts the number of work operations of the feed rod, and a third stage for determining the number of compensatory pulses to be supplied to advance the feed rod.

2. A feeding device according to claim 1 in which said third stage is actuated to supply a predetermined number of compensatory pulses to said electric actuating means each time said second stage has counted a predetermined number of work operations of said feed rod.

3. A feeding device according to claim 2 which includes a control potentiometer in circuit with said counter, and means for making said potentiometer ineffective during actuation of said third stage.

4. A feeding device according to claim 2 which includes means for supplying said compensatory pulses under the control of said third counter stage at a rate greater than the supply of feed pulses under the control of said first counter stage.

5. A feeding device according to claim 2 which includes means responsive to engagement of tool means on the feed rod with a workpiece for reducing the rate of supply of feed pulses to said feed means.

6. A feeding device according to claim 2 which includes manually operable means for adjusting said first counter stage.

7. A feeding device according to claim 2 which includes dimensionally sensitive means engageable with machined regions of a machined workpiece and operable in response to the size of the engaged region to supply a signal to cause adjustment of the setting of said first counter stage.

8. A feeding device according to claim 7 in which the adjustment of the setting of said first counting stage in response to signals from said dimensionally sensitive means is under the control of said second counting stage.

9. A feeding device according to claim 8 which includes in combination load sensitive means responsive to a predetermined axial load imposed on said feed rod by a workpiece engaged by tool means on the feed rod for interrupting the incremental feeding of said feed rod.

10. A feeding device according to claim 9 which includes limit control means responsive to a predetermined maximum advancing movement of said feed rod for interrupting operation of said machine tool.

11. A feeding device according to claim 10 in which said limit control means includes a switch actuated in response to a predetermined advancing movement of said feed rod.

12. A feeding device for a machine tool; a housing, a spindle rotatable in the housing, an axially displaceable feed rod on the axis of said spindle having one end in said spindle and the other end adapted for connection to tool means, fluid operable piston means in the housing operable for urging said feed rod in at least one direction, feed means for incrementally adjusting the axial position of said feed rod relative to the spindle, and electric actuating means operable for automatically operating at least feed means, load sensitive means responsive to a predetermined axial load imposed on said feed rod by a workpiece engaged by tool means on the feed rod for interrupting the incremental feeding of said feed rod, said load sensitive means comprising a lever actuated by movement of said piston means away from advanced position, and a control switch actuated by movement of said lever.

13. A feeding device according to claim 12 in which said fluid operable piston provides for rapid advance of said feed rod toward working position and said feed means comprises a hydromechanical transmission in said housing connected to said feed rod to effect fine advance thereof during operation of a workpiece by tool means on said feed rod.

14. A feeding device according to claim 12 in which said feed means comprises a hydromechanical transmission in said housing, a sleeve rotatably but nonaxially movably connected to said feed rod, a nut threaded on said sleeve and connected to said fluid operable piston, means on said nut presenting external teeth, said transmission comprising a reciprocable piston element, and a pivoted lever having one end engaging said piston element and the other end toothed and adjacent the external teeth on said nut.

15. A feeding device according to claim 12 in which said feed means comprises a hydromechanical transmission in said housing, a sleeve rotatably but nonaxially movably connected to said feed rod, a nut threaded on said sleeve and connected to said fluid operable piston, means on said nut presenting external teeth, a gear in the frame meshing with the teeth on said nut, and a handwheel connected to said gear.

16. A feeding device according to claim 15 which includes a rotary fluid motor in said housing connected to said gear, and means for actuating said motor for returning said nut to a predetermined selectable starting position.

17. A feeding device according to claim 12 which includes control means operable for causing said electric actuating means to emit control pulses periodically to effect said incremental adjustment of the feed rod.

18. A feeding device according to claim 17 in which said control means includes a potentiometer means adjustable for controlling the rate of supply of control pulses.

19. A feeding device according to claim 18 in which said potentiometer means comprises a plurality of potentiometers.

20. A feeding device according to claim 17 which includes measuring means for supplying a signal to said control means for making said control means ineffective.

21. A feeding device according to claim 20 in which said measuring means comprises a timer.

22. A feeding device according to claim 20 in which said measuring means comprises dimension measuring device.

23. A feeding device according to claim 20 in which said measuring means comprises a counter which counts the number of control pulses.

24. A feeding device according to claim 23 in which said counter comprises a plurality of adjustable counting stages and selector switch means for making the respective stages effective.

25. A feeding device according to claim 12 which includes a second fluid operable piston means in said frame and a second feed rod connected to the second piston means.

26. A feeding device according to claim 25 in which said second feed rod is concentric with the first mentioned feed rod.

27. A feeding device according to claim 12 which includes a counting stage, dimensionally sensitive means engageable with machined regions of a machined workpiece and operable in response to the size of the engaged region to supply a signal to cause adjustment of setting of said counting stage.

28. A feeding device according to claim 27 in which the adjustment of the setting of said counting stage is in response to signals from said dimensionally sensitive means.

29. A feeding device for a machine tool; a housing, a spindle rotatable in the housing, a counter, an axially displaceable feed rod on the axis of said spindle having one end in said spindle and the other end adapted for connection to tool means, fluid operable piston means in the housing operable for urging said feed rod in at least one direction, feed means for incrementally adjusting the axial position of said feed rod relative to the spindle, said feed means include control means for supplying said counter periodically with control pulses, said counter which counts the number of control pulses comprises a plurality of adjustable counting stages and selector switch means for making the respective stages effective to adjust incrementally the feed rod, said counting stages including a first counter stage for controlling the number of pulses supplied by said control means for advancing the feed rod, a second stage which counts the number of work operations of the feed rod, and a third stage for determining the number of compensatory pulses to be supplied to advance the feed rod.

30. A feeding device for a machine tool; a housing, a spindle rotatable in the housing, a counter an axially displaceable feed rod on the axis of said spindle having one end in said spindle and the other end adapted for connection to tool means, fluid operable piston means in the housing operable for urging said feed rod in at least one direction, feed means for incrementally adjusting the axial position of said feed rod relative to the spindle, said feed means include control means for supplying said counter periodically with control pulses, said counter which counts the number of control pulses comprises a plurality of adjustable counting stages and selector switch means for making the respective stages effective to adjust incrementally the feed rod, load sensitive means responsive to a predetermined axial load imposed on said feed rod by a workpiece engaged by tool means on the feed rod for interrupting the incremental feeding of said feed rod, said load sensitive means comprising a lever actuated by movement of said piston means away from advanced position, and a control switch actuated by movement of said lever.

* * * * *